US008827127B2

(12) United States Patent
Rekuc et al.

(10) Patent No.: US 8,827,127 B2
(45) Date of Patent: Sep. 9, 2014

(54) MAGNETICALLY ACTIVATED POSITIVE LOCKING CARRYING DEVICE

(76) Inventors: Richard Joseph Rekuc, Asbury, NJ (US); Cheung Shik Kui, Samutprakarn (TH); David Edward Ringel, Quakertown, PA (US); Grace Faye King, Quakertown, PA (US); David Joseph Rekuc, Edison, NJ (US)

( * ) Notice: Subject to any disclaimer, the term of this patent is extended or adjusted under 35 U.S.C. 154(b) by 170 days.

(21) Appl. No.: 13/635,746

(22) PCT Filed: Mar. 15, 2011

(86) PCT No.: PCT/US2011/028426

§ 371 (c)(1),
(2), (4) Date: Dec. 3, 2012

(87) PCT Pub. No.: WO2011/115939

PCT Pub. Date: Sep. 22, 2011

(65) Prior Publication Data

US 2013/0105527 A1 May 2, 2013

Related U.S. Application Data

(60) Provisional application No. 61/282,703, filed on Mar. 19, 2010.

(51) Int. Cl.

| | |
|---|---|
| ***A45F 5/00*** | (2006.01) |
| ***A45F 5/02*** | (2006.01) |
| ***A45C 15/00*** | (2006.01) |

(52) U.S. Cl.

CPC ... *A45F 5/00* (2013.01); *A45F 5/02* (2013.01); *A45F 2200/055* (2013.01); *A45F 2200/0516* (2013.01); *A45C 15/00* (2013.01); *A45F 2200/0508* (2013.01); *A45F 2200/0575* (2013.01); *A45F 2200/0541* (2013.01); *A45F 5/021* (2013.01)

USPC ..... 224/183; 224/666; 224/271; 24/3.11; 24/595.1

(58) Field of Classification Search

CPC ..... A45C 15/00; A45F 5/021; A45F 5/02; A45F 5/00; A45F 2200/0508; A45F 2200/0516; A45F 2200/055; A45F 2200/0575

USPC ..... 224/183, 271, 269, 666, 667, 671, 672, 224/677; 24/3.11, 343, 595.1, 633, 639; 70/276, 14, 20, 23, 32–34, 229, 232

See application file for complete search history.

(56) References Cited

U.S. PATENT DOCUMENTS 5,201,858 A * 4/1993 Otrusina ..... 24/573.11
6,206,257 B1 3/2001 Peele (Continued)

*Primary Examiner* — Adam Waggenspack
(74) *Attorney, Agent, or Firm* — Ober, Kaler, Grimes & Shriver; Royal W. Craig

(57) ABSTRACT

An arrangement for carrying or storing or transporting portable items for quick access by a user includes a magnetically assisted mechanical catch and carrying system which has a carrying unit with a cavity and a carried member with a protrusion that is received in the cavity. The carried member has a recess and the carrying unit has a movable latch that can be engaged into the recess for locking the carrier member in the cavity. Mutually magnetically attracting parts or materials are provided in or on the carrying unit and carried member for magnetically attracting the protrusion into the cavity. At least one or both of the latch and the protrusion are shaped to allow easy insertion of the protrusion into the cavity, or the latch may be manually pushed aside to allow insertion of the protrusion into the cavity.

14 Claims, 7 Drawing Sheets

(56) References Cited

U.S. PATENT DOCUMENTS

| | | | | |
|---|---|---|---|---|
| 6,233,788 | B1 * | 5/2001 | Choy et al. | 24/3.12 |
| 6,888,940 | B1 | 5/2005 | Deppen | |
| 7,661,620 | B2 * | 2/2010 | Fields | 242/379 |
| 2003/0047575 | A1 * | 3/2003 | Enkerlin et al. | 224/271 |
| 2009/0008419 | A1 * | 1/2009 | Tsang et al. | 224/271 |

* cited by examiner

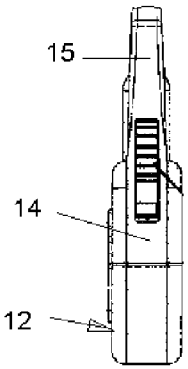
FIG. 11
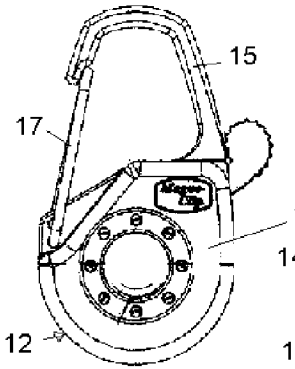
FIG. 12
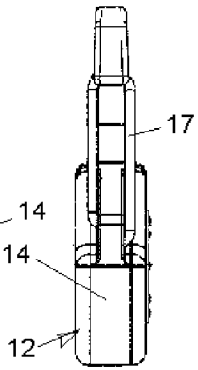
FIG. 13
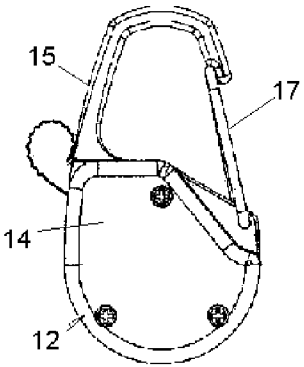
FIG. 14
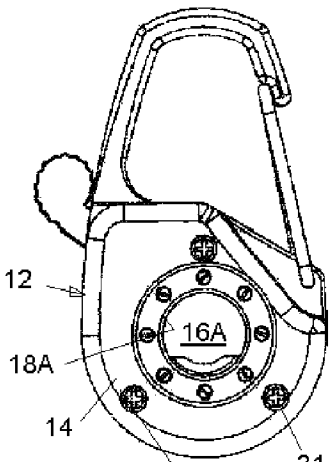
FIG. 18
FIG. 19
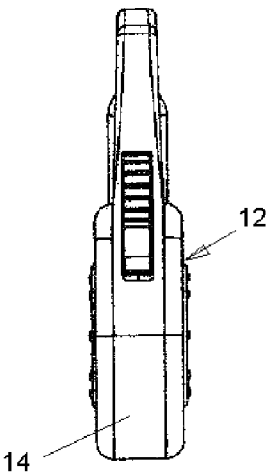
FIG. 20
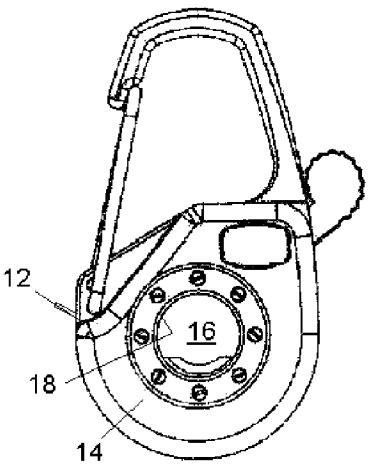
FIG. 21

MAGNETICALLY ACTIVATED POSITIVE LOCKING CARRYING DEVICE

CROSS REFERENCE TO RELATED APPLICATION

The present application claims priority on U.S. Provisional Patent Application No. 61/282,703 filed Mar. 19, 2010 which is also incorporated herein by reference.

FIELD AND BACKGROUND OF THE INVENTION

The present invention relates generally to the field of carrying devices and in particular, to a new and useful arrangement for detachably and securely locking a portable item to a carrying unit. The carrying unit may be worn by a user, for example on the user's belt, or connected to a larger item that is carried by the user, such as a handbag, backpack, brief case or other luggage, or the carrying unit may be attached to an even larger item like a vehicle or a piece of furniture or other fixed or movable fixture or surface in the user's home or work place.

There are many devices used to attach and hold or carry items, in particular, relatively small portable items. In recent years there has been a surge in such portable items that people could carry in addition to the traditional items needed for everyday living such as keys, eyeglasses, ID tags, tools and other similar items that a person would carry or need to have readily available for immediate access. In the current world, in addition to the items previously mentioned, there are MP players, cell phones (smart and otherwise), PDA's, iPod® and iPad® brand electronic handheld units, BlackBerry® brand electronic handheld units, GPS devices, pagers and small cameras, to name a few. For the purpose of this disclosure, the varied newer devices, as well as the older types of small items to be carried around, or even a case, or housing or holder or sleeve for such a new or old item are here called a "portable item." For convenience the term "other item" or "another item" is here used to denote the person or thing that will be carrying the portable item, such as the user, the user's belt, belt loop or other thing worn by the user, another larger item that is carried by the user such as a handbag, backpack, brief case or other luggage, or even larger items like a vehicle or a piece of furniture or other fixed or movable fixture or surface in the user's home or work place.

There are many and varied known devices used to help carry these portable items. There are snap hooks used to secure items to rings, loops, buckles, etc. There are pouches used to transport items and clips that attach the items to one's belt or to special sections in handbags and carrying cases. There are clips that attach some portable items directly to other items and there are magnets used to hold the portable item to a desired location.

All of these and more are ways people carry, transport or store portable items for immediate or quick access and portability. The invention disclosed here, is a better way to carry or storing or transport portable items.

SUMMARY OF THE INVENTION

It is an object of the present invention to provide an arrangement for carrying or storing or transporting portable items for quick access by a user that includes a magnetically assisted mechanical catch and carrying system which has a carrying unit with a cavity and a carried member with a protrusion that is received in the cavity, the carried member having a recess and the carrying unit having a movable latch that can be engaged into the recess for locking the carrier member in the cavity. Mutually magnetically attracting parts or materials are provided in or on the carrying unit and carried member, for magnetically attracting the protrusion into the cavity. At least one or both of the latch and the protrusion are shaped to allow easy insertion of the protrusion into the cavity, or the latch may be manually pushed aside to allow insertion of the protrusion into the cavity.

Another object of the invention is to fix the carrier member to a portable item and to provide the carrying unit with mounting means for connecting the carrying unit to a larger item such as the user, via an item of the user's clothing like a belt or belt loop, or other larger item that is carried by the user, such as a handbag, backpack, brief case or other luggage, or to an even large item like a vehicle or a piece of furniture or fixture or surface in the user's home or work place.

According to a preferred embodiment of the invention, the carrier member that is fixed to the portable item wished to be carried and transported, includes a base in the form of a disk or plate that is fixed to the portable item by attachment means such as, but not limited to, adhesives, screws, clips, etc. The carrier member also includes the protrusion that is connected to the base by a connector such as a cylindrical shaft having a smaller dimension, e.g. a smaller diameter, than the protrusion, to form the recess that is preferably an annular recess around the connecter into which the latch is received.

Part or all of the carried member, especially the protrusion, is advantageously made of or includes a metal such as iron, nickel or other magnetic material, that is attracted by a magnetic flux, and a permanent magnet is provided in the carrying unit for attracting the protrusion into the cavity.

Mounting means for connecting the carrying unit to the larger item such as the user, may be a hook and catch that is attached to the user's belt loop or other loop on the user's bag or brief case. It can, for example be, a loop, ring or buckle.

The carrying unit in its preferred form, has a magnet that attracts the magnetically attractable metal protrusion into the cavity of the carrying unit. The magnetic flux draws the protrusion into the cavity, pulling it through the ramped locking latch and into a rest area within the cavity. The protrusion also has a ramp shape around it perimeter to aid the moving aside of the latch. The latch is biased into the cavity by a spring or other biasing means so that when the protrusion is seated in the cavity the latch is urged into the recess of the carried member to lock the protrusion in the cavity and positively and mechanically lock the carried member to the carrying unit. The latch can also be drawn back from it's locked position and can be opened to receive the protrusion, then closed again to lock the protrusion. This allows the latch to secure the protrusion in the cavity with a positive lock and not to release the protrusion until the user desires to release the protrusion, and therefore the portable item connected thereto.

This action of drawing back the locking latch can also be done by the force of the magnetic flux onto the protrusion in conjunction with the shapes of the parts of the latch and protrusion that engage each other as the protrusion enters the cavity. All the user has to do is put the protrusion within range of the magnetic flux.

Since the protrusion is fixed onto or is an inherent part of something desired to be transported or stored, i.e. the portable item, this item is now fixed onto the body of carrying unit.

The release is achieved by depressing a release button, lever or activator located on the body of the carrying unit. This button or release will then move the locking latch out of its locked position, allowing the portable item to be removed by the user when they pull the protrusion out of the cavity. The only resistance is the magnetic flux. By exerting sufficient force to overcome the magnetic flux, the user removes the portable item from the carrying unit.

The invention is unique in that it allows a magnet to help seek the position needed to lock the carrying unit to the protrusion. The magnet seeks and draws the protrusion into the locking cavity, pulling the protrusion past the locking latch by pushing the latch out of the way by use of magnetic force and the ramp shapes on the protrusion or latch or both. The protrusion is now in the carrying unit cavity as the latch snaps into the recess or undercut around the connector connecting the protrusion to the base of the carrier member, and securing the protrusion in the cavity. The portable item is now secured by a positive lock created by the use of the magnetic flux and the ramp and spring tension on the latch and protrusion.

A carabineer version of the invention is also contemplated there the carrying unit body of the invention will move and seek the protrusion as much as the protrusion seeks the magnet. This greatly aids the ability to find the locking cavity and secures the parts without even having to look. By just putting the protrusion near the carrying unit, the magnetic flux then attracts the parts and they will work to find each other.

If one needs to secure or transport two items, such as a cell phone and keys, there is an embodiment of the invention where there are two locking cavities, one on one side and one on the other side of the carrying unit. The function will work the same on each side and allow the user to use the invention to secure or transport two independent items, yet have easy access to each.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 11 is a left side elevational view of the carrying unit of FIG. 1;

FIG. 12 is a front elevational view of the carrying unit of FIG. 1;

FIG. 13 is a right side elevational view of the carrying unit of FIG. 1;

FIG. 14 is a rear elevational view of the carrying unit of FIG. 1;

FIG. 18 is a left side elevational view of the carrying unit of a second embodiment of the invention;

FIG. 19 is a front elevational view of the carrying unit of the second embodiment;

FIG. 20 is a right side elevational view of the carrying unit of the second embodiment;

FIG. 21 is a rear elevational view of the carrying unit of the second embodiment;

DESCRIPTION OF THE PREFERRED EMBODIMENTS

Figure 1:
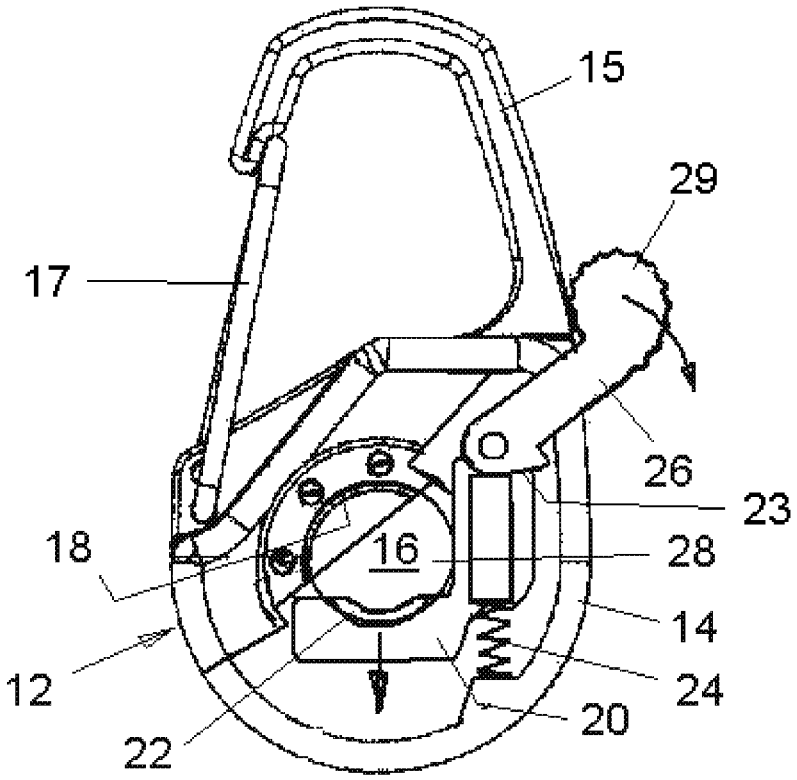
FIG. 1 is a front elevational view of a carrying unit of the invention with part of a cover of the unit cut away.
Figure 2:
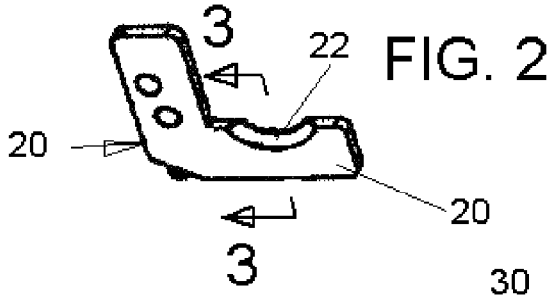
FIG. 2 is a perspective view of a latch of the invention.
Figure 3:
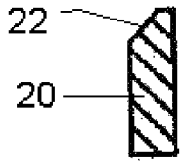
FIG. 3 is an enlarged sectional view taken along line 3-3 of FIG. 2.
Figure 4:
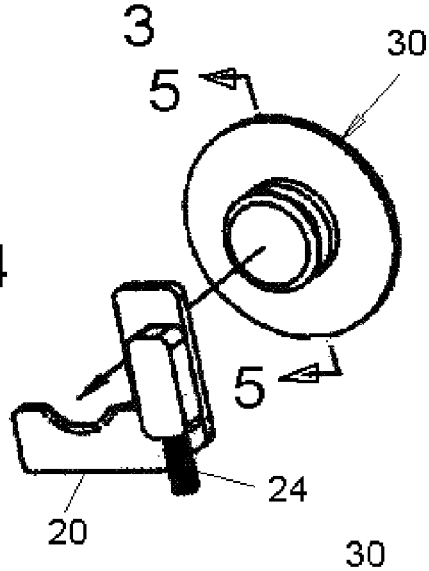
FIG. 4 is a perspective view of the latch of the invention as it is being approached by a carried member of the invention.
Figure 5:
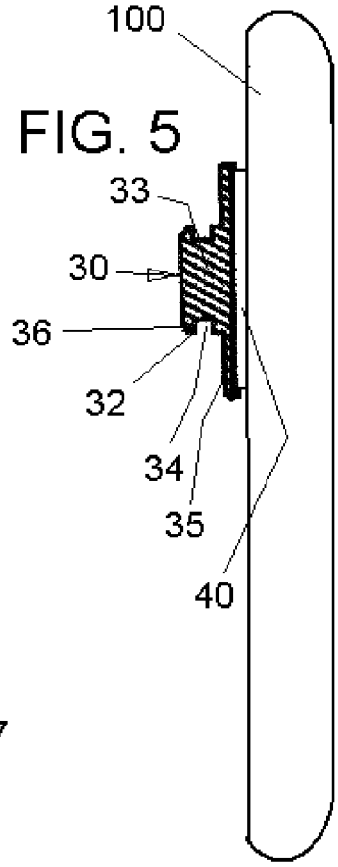
FIG. 5 is a sectional view taken along line 5-5 of FIG. 4 but with a portable item fixed to the carrier member.

Referring now to the drawings, in which like reference numerals are used to refer to the same or similar elements, FIGS. 1 to 10 illustrate an arrangement for carrying a portable item like a cell phone or other small electronic device 100 show in FIG. 5, on another item, such as a person or something the person is wearing or carrying, like a belt or handbag. As shown in FIG. 1, the arrangement comprises a carrying unit 12 having a body 14 with a circular opening 18 and a cavity 16 in the body 14 that communicates with the opening 18. A latch 20 is mounted for movement, e.g. vertical linear sliding movement, in the carrying unit body 14, between a locking position shown in FIGS. 1 and 7, and a releasing position shown in FIG. 6. The latch 20 has a blocking portion 22 that extends in a locking position, at least partly into the cavity 16 when the latch is in the upper locking position. The blocking portion 22 is at least partly withdrawn from the cavity 16 when the latch is in the lower releasing position, to allow exiting of a protrusion of a carrier member of the invention from the cavity, as will be explained later in this disclosure.

A biasing member that is here generically called a spring, and in the preferred embodiment is a steel coil compression spring 24, is engaged with latch 20 for biasing the latch toward and into its locking position. An activator 26, that in the embodiment of FIG. 1 is a lever, is engaged the latch 20. The activator 26 has a manually accessible portion 29 extending outside the carrying unit body 14, for being manually movable by a user for moving the latch 20 down into its release position to release the protrusion and allow removal of the carrier member and its attached portable item from the carrying unit. The manually accessible portion 29 of the activator 26 is a knurled handle extending outside the carrying unit body 14.

As best shown in FIGS. 4 to 9, a carried member 30 has a protrusion 32 that can be received in the cavity 16 when the portable item 100 is carried by the other item or user. The carried member 30 has a recess 34 for receiving the blocking portion 22 of the latch 20 when the latch is in its locking position for locking the carried member to the carrying unit and thus connecting the portable item to the carrying unit.

Figure 10:
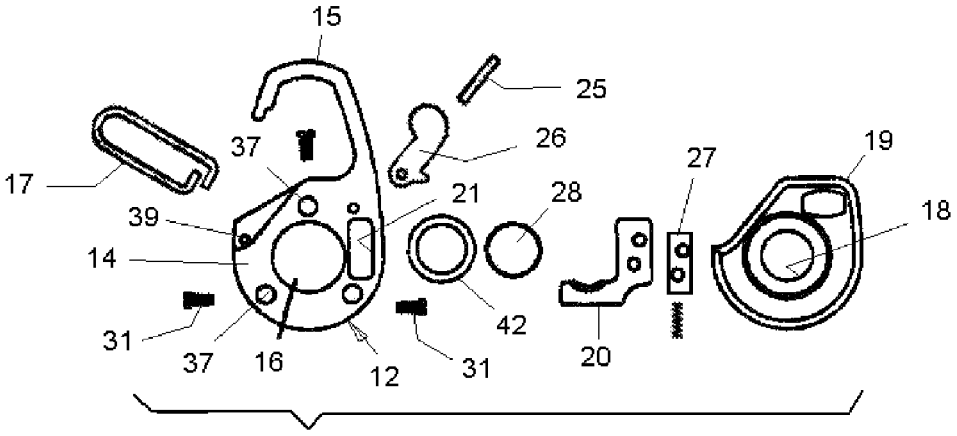
FIG. 10 is an exploded view of the individual parts that make up the carrying unit of the invention.

A permanent magnet is connected, is positioned in or is formed as a part of either the carrying unit 12 or the carried member 30, or both, the other of the carrying unit or carried member being at least partly made of or containing a magnetically attractable material so that when the protrusion 32 is near the cavity 16, the protrusion is urged by magnetic attraction to enter the cavity 16 through the opening 18. In a preferred embodiment of the invention, and as shown in FIG. 10, a permanent magnet 28 is in the cavity 16 at its base for attracting the carrier member 30 that is made or contains magnetically attractable material like iron or nickel or other magnetically attractable material. Alternatively carrier member 30 may also be a permanent magnet with its North pole facing a South pole of the magnet 28, or visa versa, or carrier member 30 may be a permanent magnet and the interior of cavity 16 at least near 28 may be or contain magnetically attractable material like iron or nickel or other such material.

Figure 16:
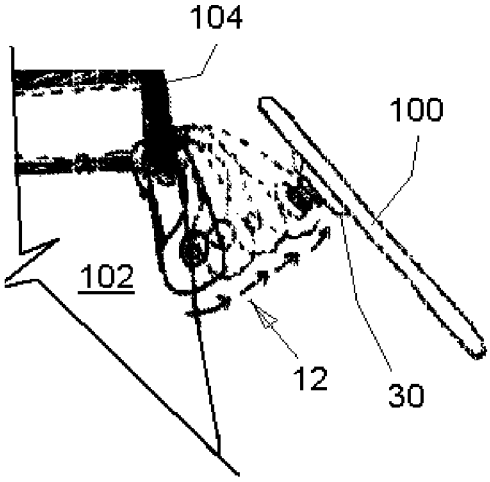
FIG. 16 is a diagram illustrating a later moment in the action as the carrying unit that is hung on a belt loop of a user, is being magnetically attracted to the carried member of the invention.
Figure 17:
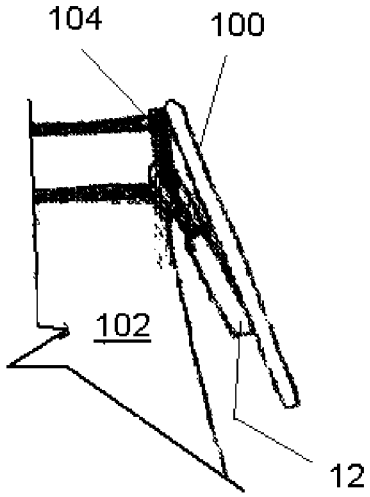
FIG. 17 is a diagram illustrating a still further moment in the action after the carried member has been captured by and locked to the carrying unit of the invention.

Attachment means, such as but not limited to an adhesive pad 40, fixes the carried member to the portable item 100 to be carried by the carrying unit 12. These attachment means may alternatively be another type of adhesive, one or more screws, a clip, one or more rivets, a clamp, a press fit pin or pins, or some other mechanism that will attach the carrier member to the portable item or even to a carrying case or housing or sleeve for the portable item. Mounting means are also provided for connecting the carrying unit 12 to another item like the user, his or her clothing, or an item the use is carrying, for carrying the portable item 100. A preferred embodiment for these mounting means is a hook 15 formed on the carry unit body 14 for hooking onto a loop of another item, like a belt loop, a backpack, brief case, handbag or luggage ring, or the like. In an even more preferred embodiment the mounting means includes the hook 15 forming an entry passage with another portion of the carry unit body 14, and spring loaded catch 17 movably mounted to the carry unit body 14 for closing and opening the passage to receptively admit and trap a loop of another item 102 for carrying the portable item 100. In this way the carrying unit 12 acts like a carabineer that is suspended from the loop and can swing freely thereon as will be better explained in connection with FIGS. 15 to 17.

According to another aspect of the invention, at least one of the protrusion 32 and the blocking portion 22 of the latch 20, and preferable both, are shaped so that with the magnetic attraction pulling the protrusion into the cavity, the latch 20 is temporarily moved aside, toward its release position, to allow the protrusion 32 to pass the latch 20 and enter the cavity 16, whereupon the latch moves to its locking position with the blocking portion 22 entering the recess 34 of the carrier member to lock the portable item to the carrying unit.

Figure 15:
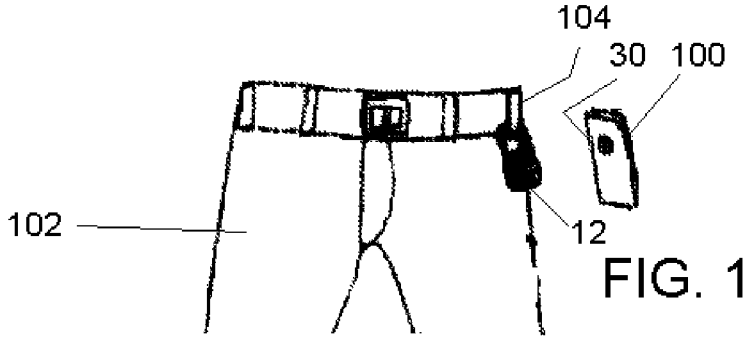
FIG. 15 is a diagram illustrating the action of the invention as a portable item like a smart phone to which a carried member of the invention is fixed, approaches the carrying unit of the invention.

FIG. 15 shows the invention as the portable item 100 is approaching the carrying unit 12, for example after a user 102 has finished a phone call and is returning the cell phone 100 to the carrying unit 12. As the distance between the carrier member 30 and carrying unit 12 becomes small, for example about 1 to ½ inch, the magnetic attraction between the two will cause the hanging carabineer-like carrying unit 12 to swing up on the belt loop 104 it has been hooked onto, toward the hand held portable item 100 in the direction of the arrows.

Figure 6:
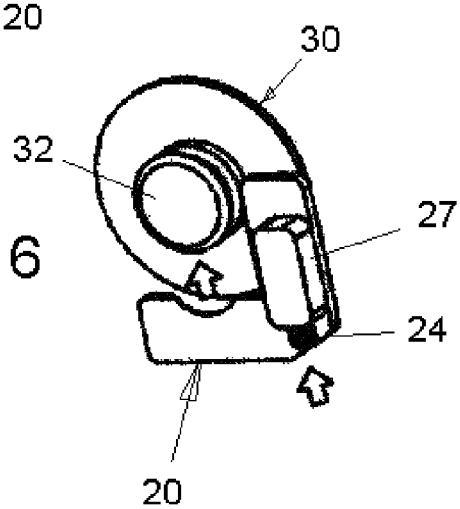
FIG. 6 is a view similar to FIG. 4 showing the latch and carried member just before the latch is biased into its locking position.
Figure 7:
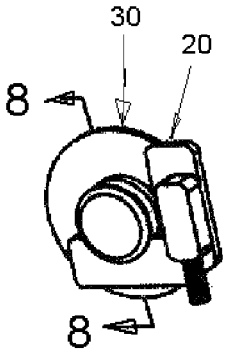
FIG. 7 is a view similar to FIG. 4 showing the latch and carried member after the latch has been biased into its locking position.
Figure 8:
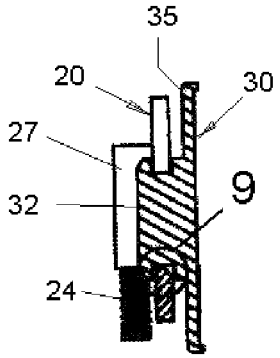
FIG. 8 is a sectional view taken along line 8-8 of FIG. 7.
Figure 9:
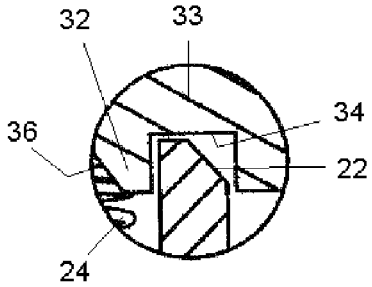
FIG. 9 is an enlarged sectional view taken from area 9 of FIG. 8.

Returning to FIGS. 2 to 6, the special shaped of the protrusion 32 or the blocking portion 22 or both that permits entry and locking of the protrusion 32 in the cavity 16 is preferably achieved by having the protrusion 32 of the carried member 30, formed as a circular disc with a ramped or beveled outer perimeter 36 facing the opening 18 in the carrying unit body 14 when the protrusion is to enter the cavity 16. This is illustrated in FIG. 4. The blocking portion 22 of the latch 20 is also concavely arcuate and ramped or beveled facing outwardly of the opening 18 from the cavity 16 as shown FIGS. 1, 2 and 3, so that with a magnetic attraction pulling the protrusion into the cavity, the beveled perimeter 36 and beveled blocking portion 22 engage each other to cause the latch 20 to temporarily move toward its release position as shown in FIG. 6, to allow the protrusion to pass the latch and enter the cavity 16 whereupon the latch moves to its locking position with the blocking portion 22 entering the recess 34 of the carrier member as shown in FIGS. 7, 8 and 9.

The carrier member 30 as shown in FIG. 5, has a base 35 adapted to be fixed to the portable item 100 by the attachment means 40 and a connector 33 connecting the protrusion 32 to the base, the recess 34 being in the connector. The carrier member 30 preferably has a flat disc-shaped base 35 having opposite surfaces, one surface of the base being adapted to be fixed to the portable item 100 by said attachment means, a cylindrical connector 33 connecting the protrusion 32 to the opposite surface of the based, and the cylindrical connector 33 having a smaller diameter than the base and containing said recess 34. The recess 34 is preferable an annular recess around the connector 33, the protrusion 32 being flat and circular and having a diameter that is substantially equal to the diameter of the cylindrical connected 33 and larger than a diameter of the recess 34.

As shown in FIG. 10 which is an exploded view of the carrying unit, the permanent magnet comprises a disk magnet 28 that is inserted into the cavity 16 in the carrying unit body 14. The latch 20 has a rectangular journal portion 27 that is linearly slidably mounted in a slightly larger rectangular bearing box 21 formed in the carrying unit body 14. The activator 26 has a lower cam surface 23 (see FIG. 1) that is engaged with the top of the journal portion 27 and the spring 24 is engaged between the bottom of the journal portion 27 and the carrying unit body in the bottom of bearing box 21. The carrying unit 12 includes a cover 19 defining the opening 18 into the cavity 16 and is connected to the carrying unit body 14 over the bearing box and an L-shaped part of the latch 20, by screws 31 that are inserted from the rear of the body 14 through openings 37, and are threaded into holes in the rear surface of the cover 19.

Activator 26 is mounted for rotation to the body 14 by a pin 25 shown in FIG. 10. To center the disk magnet 28 in the cavity 16 in the carrying unit body 14, a spacer ring 42 is provided around the disk magnet 28. The catch 17 is formed of a U-shaped length of spring metal which, as seen in FIG. 10, has a pair of off-set, inwardly bend free ends that engaged in holes 39 on opposite sides of the body 14, on a portion of the body 14 that defines the passage with the free end of the hook 15. This caused the catch 17 to be naturally biased against an inside surface of the free end of the hook 15 and allows the catch to be pushed inwardly of the passage to allow entry of a loop or ring or the other item, like the action of the gate of a carabiner, so the carrying unit 12 can hung freely on the loop or ring.

The latch 20 is L-shaped in the embodiment of FIGS. 1-17 and has a vertical leg mounted for linear movement in the carrying unit body 14, via the journal portion 27, and a horizontal leg that carries the acuate, ramped blocking portion 22, the spring 24 being a coil compression spring engaged between the vertical leg of the latch 20 via its journal portion, and the carry unit body 14, the cam surface 23 engaging the vertical leg of the latch for moving the latch when the activator 26 is rotated on its pin 25, and the manually accessible portion comprising the knurled handle 29 and extending outside the carrying unit body.

Figure 22:
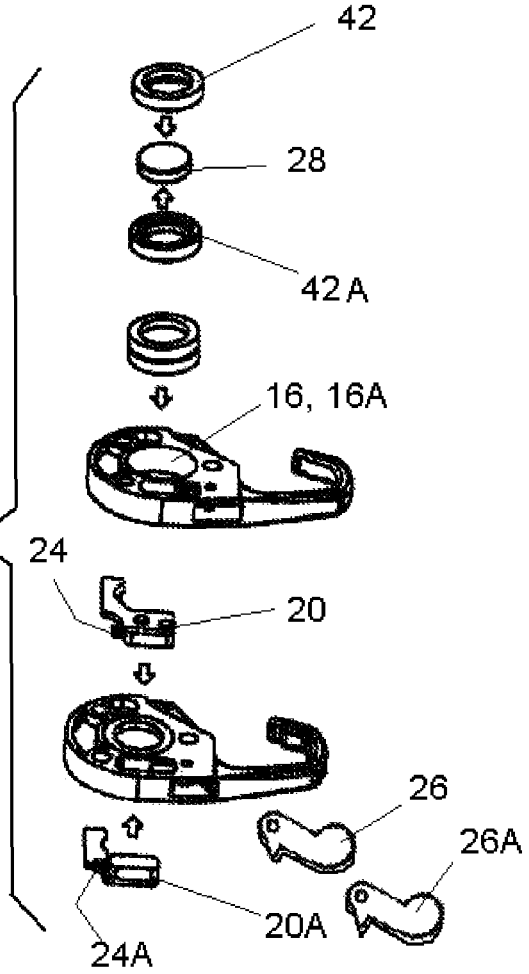
FIG. 22 is an exploded explanatory view of the assembly process for the second embodiment.
Figure 23:
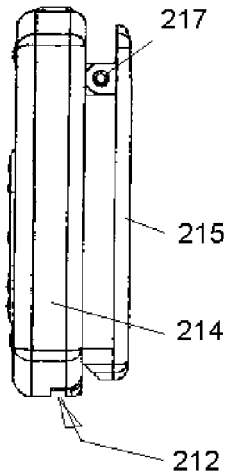
FIG. 23 is a left side elevational view of the carrying unit of a third embodiment of the invention.
Figure 24:
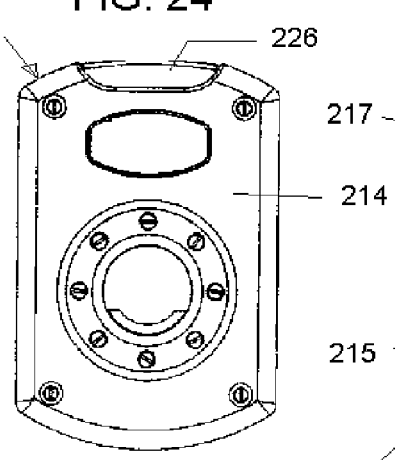
FIG. 24 is a front elevational view of the carrying unit of the third embodiment.
Figure 25:
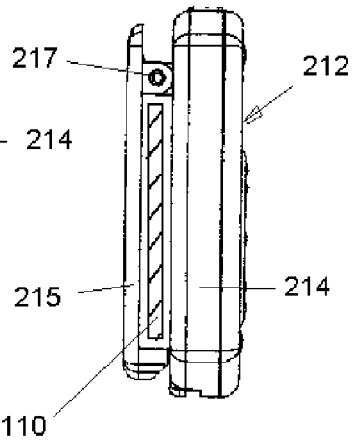
FIG. 25 is a right side elevational view of the carrying unit of the third embodiment.
Figure 26:
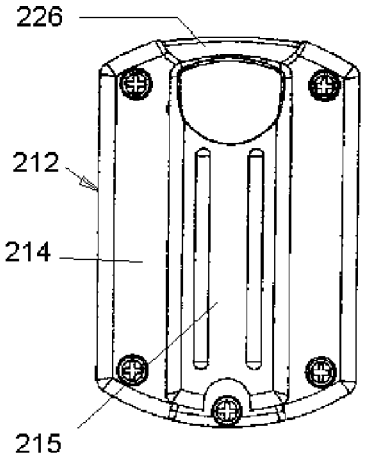
FIG. 26 is a rear elevational view of the carrying unit of the third embodiment.
Figure 27:
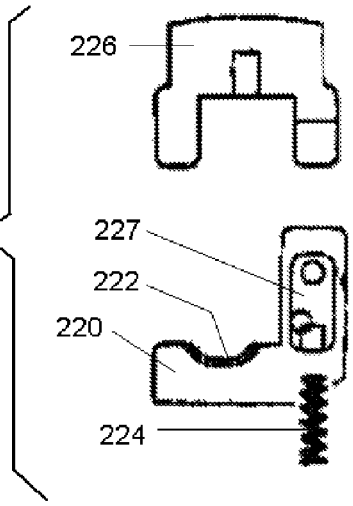
FIG. 27 is an exploded view of the latch and button of the embodiment of FIGS. 23 to 26.

FIGS. 11 to 14 are two side, a front and a rear view of the carrying unit 12 that better show the carabiner-like hook 15 and catch 17 on the carrying unit body 14. Respectively corresponding views of a second embodiment of the invention are in FIGS. 18 to 21 where invention differs from the first embodiment by including two protrusion receiving openings 18 and 18A with corresponding cavities 16 and 16A on opposite sides of the carrying unit body 14. This permits the engagement of two portable items on one carrying unit, such as a cell phone on one side and a set of keys on the other. FIG. 22 shows the inside structure and assembly of the second embodiment that is like the embodiment of FIG. 1, except that it has an entry opening 18 and 18A on both sides of the body 14 instead of the one entry point 18 as seen in FIG. 1. Near the top of FIG. 22, two rings 42 and 42A are engaged on opposite sides of the disk shaped permanent magnet 28 to hold and center the magnet, both side-to-side and front-to-back, before this assembly of rings and magnet are placed into the double cavity 16, 16A. At the bottom of FIG. 22, the two latches 20 and 20A are installed and covers shown in FIGS. 19 and 20, each with their own opening 18 and 18A are attached to the opposite sides of the carrying unit body, e.g. by screws. A pair of activators 26 and 26A are also installed so that the latches 20 and 20A can be individually moved to selectively release the protrusion from each cavity 16 and 16A, or move together to release both.

In the second embodiment of FIGS. 18 to 22, the magnet is 28 is located in the center of the body 14 between the openings 18 and 18A, the locking latches 20 and 20A being located behind each respective opening. Magnet 28 is fixed in and is correctly centered between the cavities 16 and 16A by the pair of rings 42 and 42A. The activators 26 and 26A can be separately or together manually pivoted to compress springs 24 and 24A that are biasing the latches 20 and 20A, manually release protrusions on both sides of the magnet 28 to remove a portable item from each side of the carrying unit by applying a force that is sufficient to overcome the magnetic pull of the magnet. The user can thus secure one or two articles to the unit.

Referring now to FIGS. 23 to 27, a third embodiment of the invention is illustrated that includes a push button 226 to slide a latch inside a carrying unit body 214 of the carrying unit 212 of this embodiment. The mounting means for connecting the carrying unit to another item in the third embodiment comprises a clip 215 formed on, connected to, or pivotally mounted to the back of the carry unit body 214 for hooking onto a belt that might be a belt worn the user, or a belt on another piece of luggage like a handbag, backpack or briefcase, or another structure onto which the clip might be engaged, that are all here called a belt for convenience. Clip 215 is pivotally mounted to the body 214 at the top at pivot ears and shaft 217 in the embodiment of FIG. 25 and is spring loaded so that when a top end of the clip 215 is pressed toward the body 214 its bottom end will pivot away from the body 214 so that the carrying unit 212 can be slipped or hooked onto a belt shown at 110 in FIG. 25, and then be biased back to its closed position shown in FIGS. 23 and 26. The bottom of clip 215 has an angled piece that extends back toward the carrying unit body 214 to close a loop formed by the body 214 and the clip 215, to better secure the carrying unit to the belt 110.

Alternatively clip 215 is fixed to the body 214 at the top and bottom and in that case defines a closed loop into which the belt 110 can be slide. A shown in FIG. 27, latch 220 is slidably mounted in carrying unit body 214 and is spring loaded by spring 224 in the upward direction, spring 224 being captured between a part of the body 214 and a journal portion 227 of latch 220 in the same way that latch 20 of FIGS. 1-17 operate, latch 220 have a blocking portion 222 that locked a protrusion 32 of a carried member 30 as shown in FIG. 5.

While specific embodiments of the invention have been shown and described in detail to illustrate the application of the principles of the invention, it will be understood that the invention may be embodied otherwise without departing from such principles.

What is claimed is:

1. An arrangement for releasably attaching a portable item to another item comprising:

a first unit having a body with an opening and a cavity communicating with the opening;

a latch mounted for movement in the first unit body between a locking position and a releasing position, the latch having a blocking portion extending into the cavity when the latch is in the locking position and withdrawn from the cavity when the latch is in the releasing position;

a spring engaged with the latch for biasing the latch into the locking position;

an activator exposed outside the carrying unit body for access by a user to move the latch into its releasing position;

a second unit having a protrusion that is received in the cavity of said first unit, the protrusion being defined by a surrounding recess for receiving the blocking portion of the latch when the latch is in its locking position, thereby locking the first unit to the second unit;

a permanent magnet proximate one of the cavity or protrusion of said first or second units, and a magnetic material proximate the other of said cavity or protrusion;

whereby as the protrusion nears the cavity, the protrusion is pulled by magnetic attraction to enter the cavity through the opening, and as the protrusion is pulled into the cavity it overcomes the spring-bias and withdraws said blocking portion from the cavity, until said blocking portion falls in to said surrounding recess locking said latch in its locking position.

2. The arrangement of claim 1, wherein said protrusion comprises a connector having a distal circular disc at one end of greater diameter than said connector, said disc having a beveled outer perimeter.

3. The arrangement of claim 2, wherein said connector has a base at its other end adapted to be fixed to the portable item.

4. The arrangement of claim 2, wherein said connector is cylindrical and said recess is an annular recess surrounding said cylindrical connector.

5. The arrangement of claim 1, wherein the latch is mounted for linear movement in the carrying unit body.

6. The arrangement of claim 1, wherein the activator comprises a lever extending outside the carrying unit body.

7. The arrangement of claim 1, wherein said first unit comprises a hook extending from said body for hooking onto another object, and a spring-biased catch for closing said hook.

8. The arrangement of claim 1, wherein the latch is L-shaped and has a vertical leg mounted for linear movement in the carrying unit body and a horizontal leg that carries the blocking portion, the spring being a coil compression spring engaged between the vertical leg of the latch and the carry unit body, the activator being a lever that is mounted for rotation to the carry unit body, the lever having an activating portion with a cam surface for engaging the vertical leg of the latch for moving the latch when the activator is rotated, the manually accessible portion comprising a knurled handle extending outside the carrying unit body.

9. The arrangement of claim 1, wherein said cavity comprises a substantially circular cavity and the permanent magnet comprises a disk magnet seated in the cavity.

10. The arrangement of claim 9, further comprising a spacer ring around the disk magnet.

11. The arrangement of claim 1, wherein said body has opposing sides and an opening and a cavity on each of said opposing sides.

12. The arrangement of claim 1, further comprising a clip mounted to said first unit body for hooking onto a belt.

13. The arrangement of claim 12, wherein said clip is pivotally mounted to said first unit body for hooking onto a belt.

14. The arrangement of claim 5, wherein the activator comprises a lever extending outside the carrying unit body.

* * * * *